United States Patent [19]

Weingardt

[11] 4,428,577

[45] Jan. 31, 1984

[54] EXERCISER

[75] Inventor: Wilfred W. Weingardt, Cedar Crest, N. Mex.

[73] Assignees: Michael Croom; Harold Weingardt, both of Albuquerque, N. Mex. ; part interest to each

[21] Appl. No.: 60,810

[22] Filed: Jul. 25, 1979

[51] Int. Cl.[3] ..... A63B 21/32

[52] U.S. Cl. ..... 272/135; 272/137; 272/143

[58] Field of Search ..... 272/135, 137, 143, DIG. 4, 272/67, 68; 128/25 R, 63; 73/379, 380, 381; 35/29 R

[56] References Cited

U.S. PATENT DOCUMENTS

| | | | |
|---|---|---|---|
| 192,338 | 6/1877 | Marshall | 272/135 |
| 610,716 | 9/1898 | Marshall | 272/135 |
| 1,495,278 | 5/1924 | Titus | 272/137 |
| 1,576,474 | 3/1926 | Walker | 272/137 |
| 1,620,910 | 3/1927 | Minnich | 272/137 |
| 3,451,675 | 6/1969 | Burzenski | 272/137 |
| 3,638,939 | 2/1972 | Langley | 272/DIG. 4 X |
| 3,884,464 | 5/1975 | Evangelos | 272/135 |

FOREIGN PATENT DOCUMENTS

| | | | |
|---|---|---|---|
| 697861 | 11/1964 | Canada | 35/29 R |
| 1195209 | 6/1965 | Fed. Rep. of Germany | 272/135 |
| 3157 | of 1903 | United Kingdom | 272/68 |
| 226048 | 12/1924 | United Kingdom | 272/68 |
| 433319 | 8/1935 | United Kingdom | 272/68 |

*Primary Examiner*—Robert A. Hafer
*Assistant Examiner*—Arnold W. Kramer
*Attorney, Agent, or Firm*—Mason, Fenwick & Lawrence

[57] ABSTRACT

An exercise device has a flexible steel blade with handles attached to each end and each handle having a plurality of hand grip members progressively outwardly spaced for hand engagement by the user with the flexible steel blade being enclosed in a foam rubber cloth covered cushion.

3 Claims, 4 Drawing Figures

EXERCISER

This invention is in the field of exercise devices and is more particularly directed to a hand-held exercise device capable of being used for exercising the vast majority of the body muscles.

Previously known exercise devices have employed a wide variety of constructions using springs, weights, pulleys and other mechanisms frequently requiring an expensive space-consuming installation. Other portable exercise devices have been proposed with such devices frequently employing springs, stretch members or the like some of which are eventually prone to mechanical failure with the consequent likelihood of injury to the user. Moreover, many of the prior known exercise devices are capable of inflicting the user with substantial injury at any time if the user improperly uses the device or becomes careless.

It is well known that a person initially beginning the use of an exercise device finds that the device soon loses its effectiveness as the strength of the user increases with continued use of the device so that it is consequently necessary to obtain a replacement device of greater strength or to modify the original device by the addition of further springs or the like to increase its resistance to the muscular movements of the user. Additionally, this fact frequently means that a single exercise device cannot be used by a plurality of users having different strength capability. Consequently, each user must have his own exercise device or make necessary adjustments in an adjustable device prior to use.

Thus, there continues to be a need for an exercise device that is economical to fabricate and use and which has versatility and safe operating characteristics.

Therefore, it is the primary object of this invention to provide a new and improved exercise device.

Yet another object of the invention is the provision of a new and improved exercise device that is safe to use.

Another object of this invention is the provision of a new and improved exercise device which can provide different reaction forces for a particular exercise without any need for adjusting or modifying the device in any manner.

Achievement of the foregoing objects is enabled by the preferred embodiment which comprises an elongated rectangularly shaped flexible steel plate to each end of which a handle member is attached. Each of the handle members includes a plurality of parallel hand grip elements of cylindrical configuration progressively faced outwardly from the end of the spring plate member so that the reactive force of the spring plate member against the hands of the user can be varied by the selection of a particular pair of the hand grip members. Additionally, the spring plate means is covered with a foam rubber pad protected by a cloth cover so that the spring plate cannot cut or otherwise injure the user even if the device is carelessly used.

A better understanding of the preferred embodiment will be achieved when the following detailed description is considered in conjunction with the appended drawings in which.

Figure 1:
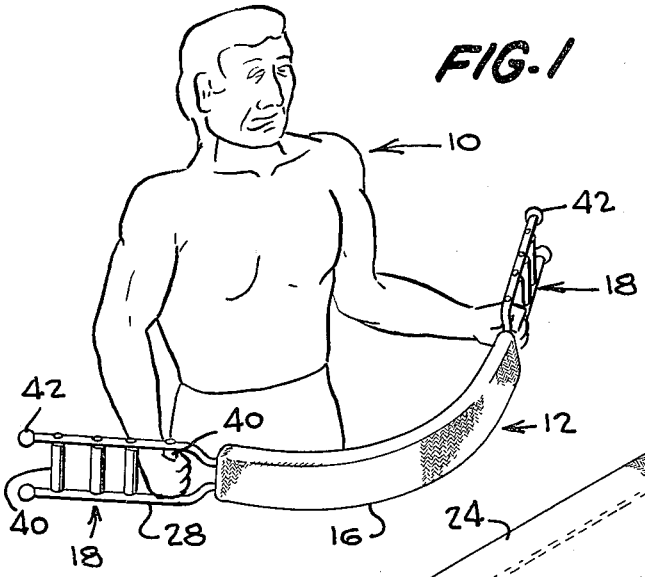
FIG. 1 is a perspective view illustrating the manner of using the preferred embodiment.
Figure 2:
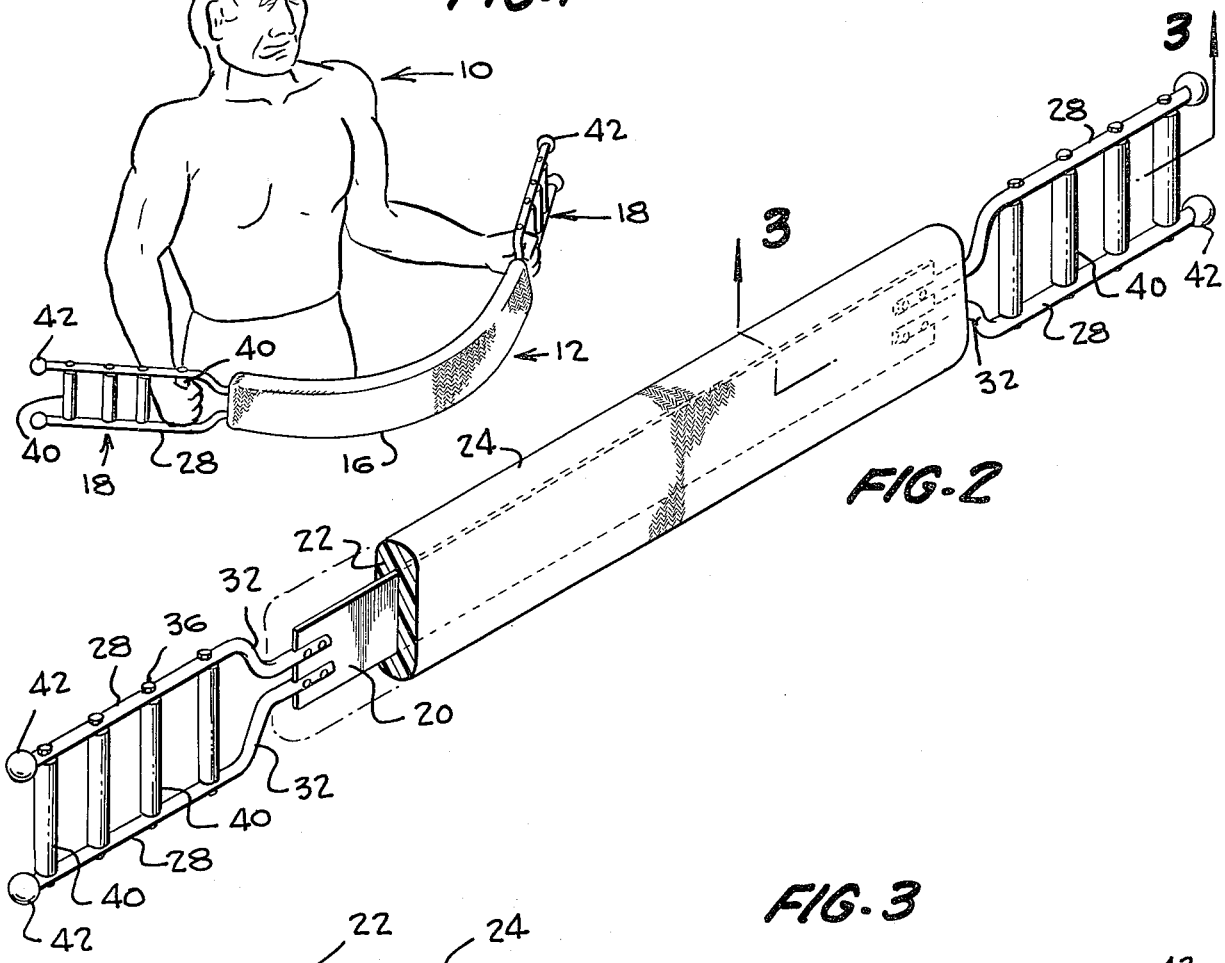
FIG. 2 is a perspective view of the preferred embodiment with a portion removed for clarity of illustration.
Figure 3:
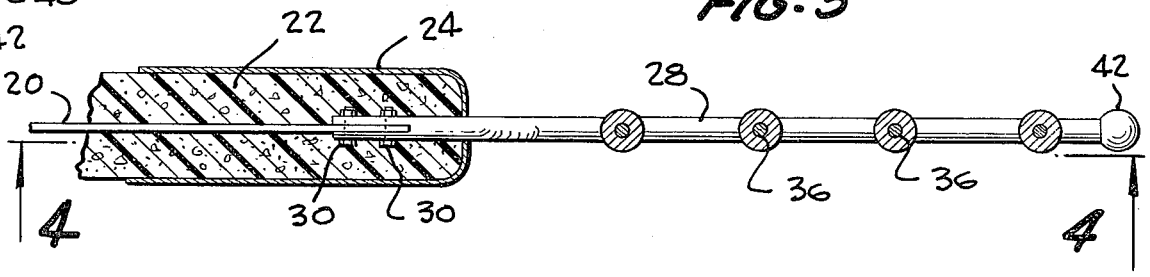
FIG. 3 is a sectional view taken along lines 3—3 of FIG. 2.

Attention is initially invited to FIG. 1 of the drawings which illustrates a user 10 exercising with the preferred embodiment 12. The main components of the preferred embodiment include a central spring blade portion 16 and handle means 18 provided at opposite ends of the central blade portion.

More specifically, the central spring blade portion comprises a rectangularly shaped flexible steel blade 20 of approximately $\frac{1}{8}$th inch thickness which is enclosed in a protective cushion comprising a body of foam rubber 22. A protective cloth cover 24 encloses the foam rubber body 22 so as to protect the user from any possibility of injury from the steel blade member.

Figure 4:
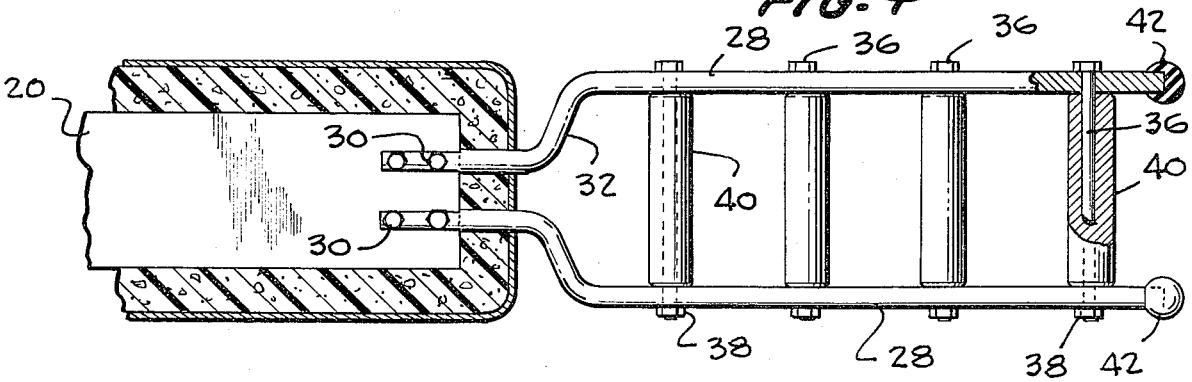
FIG. 4 is a sectional view taken along lines 4—4 of FIG. 3.

Each of the handle means 18 comprises a pair of aluminum hand grip support rods 28 attached by connector means 30 such as nut and bolt connectors or rivet connectors to one end of the flexible steel blade 20. It will be observed that the aluminum hand grip support rods 28 flair outwardly in area 32 with their outer portions being parallel and providing support for a plurality of bolt members 36 extending through aligned bores in the rods 28 and held in position by nut members 38. A plurality of cylindrical hand grip members 40 are mounted on the bolt members 36 and are oriented parallel to each other as best shown in FIG. 4. The hand grip members can be formed of wood, plastic, rubber or the like and are of sufficient length to permit them to be easily grasped by the user as shown in FIG. 1. Additionally, rubber cushion cap members 42 are mounted on the ends of the rods 28 to provide further protection for the user.

The preferred embodiment can be used in a wide variety of ways for exercising various muscles of the body. For example, the padded central blade portion 16 can be engaged with the abdominal muscles and the handles pulled rearwardly, the padded central portion can be engaged with the back of the neck and the handles pulled forwardly, the padded portion can be engaged beneath the foot of the user and the handles lifted upwardly. In like manner, the central portion can be engaged with the spine and the handles pushed forwardly by the user. Moreover, various other uses and methods of employing the subject device will obviously occur to those of skill in the art. Additionally, it should be understood that modification of the preferred embodiment will undoubtedly occur to those of skill in the art and that the spirit and scope of the invention is to be limited solely by the appended claims.

I claim:

1. An exercise device comprising an elongated spring blade having first and second ends, first and second handle means respectively connected to said first and second ends of said elongated spring blade and protective cushion means enclosing said elongated spring blade for protecting the user against accidental injury thereby, wherein said elongated spring blade is a rectangular relatively thin metal blade, said first and second handle means each comprises a plurality of individual tubular hand grip members mounted on first and second support rods attached to each end of the elongated spring blade and extending parallel to and fixedly positioned with respect to each other and progressively spaced away from one end of said blade to which their respective first and second support rods are connected, said protective cushion means comprises a foam rubber pad encased in a protective fabric cover and further including a cushion cap member mounted on the outer end of each of said rod members.

2. An exercise device comprising an elongated spring blade having first and second ends, first and second handle means respectively connected to said first and second ends of said elongated spring blade and protective cushion means enclosing said elongated spring blade for protecting the user against accidental injury thereby, wherein said elongated spring blade comprises an elongated rectangular flexible steel blade, said first and second handle means each comprises a plurality of individual tubular parallel cylindrical hand grip members mounted on handle support means on each end of the elongated rectangular steel blade progressively spaced away from the end of said elongated rectangular steel blade, and said handle support means comprises two aluminum rods on each end of the elongated rectangular flexible steel blade and including a plurality of bolt members each extending between said two aluminum rods and an axial opening through each of said cylindrical hand grip members.

3. The invention of claim 2 wherein said protective cushion means comprises a foam rubber pad encased in a protective fabric cover and further including a cushion cap member mounted on the outer end of each of said aluminum rods.

* * * * *